US006105502A

United States Patent [19]

Wagner et al.

[11] Patent Number: 6,105,502

[45] **Date of Patent: *Aug. 22, 2000**

[54] REACTIVE INK PRINTING PROCESS

[75] Inventors: Barbara Wagner; Kimberlee Thompson; Ming Xu, all of Mt. Pleasant, S.C.

[73] Assignee: Sawgrass Systems, Inc., Mt. Pleasant, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/166,057

[22] Filed: Oct. 2, 1998

[51] Int. Cl.[7] ..... B41F 31/00

[52] U.S. Cl. ..... 101/491; 101/483; 101/492; 106/31.27; 106/31.45; 106/31.58; 106/31.6; 106/31.75; 106/31.86

[58] Field of Search ..... 106/31.27, 31.45, 106/31.58, 31.6, 31.75, 31.86; 101/483, 491, 492

[56] References Cited

U.S. PATENT DOCUMENTS

| | | | |
|---|---|---|---|
| 4,589,920 | 5/1986 | Kanada et al. . | |
| 4,730,021 | 3/1988 | Zom et al. | 524/457 |
| 4,732,616 | 3/1988 | Kondo et al. . | |
| 4,847,316 | 7/1989 | Schick et al. | 524/88 |
| 4,849,262 | 7/1989 | Uhl et al. . | |
| 4,874,798 | 10/1989 | Koleske et al. | 522/31 |
| 5,316,885 | 5/1994 | Sasaki et al. | 430/200 |
| 5,418,016 | 5/1995 | Cornforth et al. | 427/515 |
| 5,556,935 | 9/1996 | Traubel et al. . | |
| 5,607,482 | 3/1997 | Reiff et al. . | |
| 5,725,646 | 3/1998 | Krishnan et al. . | |
| 5,778,789 | 7/1998 | Krishnan et al. . | |

FOREIGN PATENT DOCUMENTS

| | | |
|---|---|---|
| 58-152073 | 9/1983 | Japan . |

*Primary Examiner*—Ren Yan
*Assistant Examiner*—Daniel J. Colilla
*Attorney, Agent, or Firm*—B. Craig Killough

[57] ABSTRACT

A color image is printed onto a first substrate, which acts as an intermediate medium, using lithography, intaglio, gravure, relief printing or other printing process which uses plates. The image is subsequently transferred from the intermediate medium to a final substrate, which may be a textile of natural fabric, such as cotton.

Bonding and/or crosslinking of the color images are provided by the reaction between compounds selected from each of two chemical groups. The first group comprises compounds with functional groups capable of reacting with active hydrogen, such as isocyanate or epoxy groups. The second group comprises compounds with functional groups containing active hydrogen, or compounds with functional groups containing active hydrogen after a conversion process. The functional groups of one or both reactive chemical groups are protected either by chemical blocking with blocking agents or by physical barrier such as encapsulating agents. The blocking agents are removed by the application of heat during the transfer of the image from the first substrate to the final substrate.

9 Claims, No Drawings

REACTIVE INK PRINTING PROCESS

BACKGROUND OF THE INVENTION

Screen printing is one of the conventional processes for printing images directly onto textiles. Screen printing inks consist of pigments dispersed in an aqueous print paste which contains binder and crosslinkable fixing agent. These mixtures crosslink at a higher temperature after the printing operation, thereby fixing the print on the textile. The several disadvantages of commercial crosslinkable fixing agents include undesirable byproducts, such as formaldehyde, short pot life, and difficult dispersion.

Uhl et. al., U.S. Pat. No. 4,849,262, discloses a printing paste and dyeing liquor containing fine particle dispersions of polyisocyanates in a deactivated form. The deactivation of the particle surfaces is achieved by the dispersion of polyisocyanates in the presence of media which is reactive with isocyanate. Only the isocyanate groups which are present on the surface of the particles react with the deactivating agent. The rest of the polyisocyanate molecules in the interior of the particle remain unreacted. The deactivation compounds form a sort of polymer shell on the surface of the polyisocyanate particles which is removed with heat.

Traubel et al., U.S. Pat. No. 5,556,935, discloses a textile printing paste containing a hydrophilically modified polyisocyanate crosslinking agent. A hydrophilic polyisocyanate prepolymer is used in association with polyepoxide compounds and modified polycarbodiimides. Reiff et al., U.S. Pat. No. 5,607,482, discloses a textile printing paste containing a chemically blocked polyisocyanate crosslinking agent. A hydrophilic polyisocyanate is blocked to prevent reaction. In both of the above cases, aqueous or oil-in-water emulsion print pastes are required due to the hydrophilic nature of the paste components.

Modern lithography is based on modifying the surface properties of coated metal plates. The most common are zinc or aluminum printing plates coated with a light-sensitive oleophilic and hydrophobic material. When the plate is exposed to light through a photographic color separation negative, the exposed areas become "cured" so that the film can be washed off in the unexposed areas. Thus the design becomes reproduced on the plate in a pattern of oleophilic image areas and hydrophilic non-image areas. The image area accepts an oil-based ink and the non-image area does not. In general, the non-image area is constituted by a hydrophilic area accepting water. Accordingly, ordinary lithographic printing is conducted by supplying both a colored ink and an aqueous fount, or fountain ink, to the surface of a printing plate whereby the oil-based ink and the fountain ink are selectively accepted by the image area and the non-image area of the plate, respectively. The process is termed offset lithography because the colored inked image is first offset onto a rubber roller, followed by transfer to paper. The lithographic process is a balance between the properties of the ink, fount, and printing plate.

Common vehicles for lithographic inks include drying oils, synthetic drying oils, rosins, such as copal, dammar, shellac, hardened rosin, and rosin esters, phenolic resins, such as rosin-modified phenolic resins and 100% phenolic resins, maleic acid resins, alkyd resins, petroleum resins, vinyl resins, acrylic resins, polyamide resins, epoxy resins, aminoalkyd resins, polyurethane resins, aminoplasts, cellulose derivatives such as nitrocellulose and ethylcellulose, glue, casein, dextrin, and the like. Other additives generally used in lithographic printing inks include waxes, greases, plasticizers, stabilizers, drying agents, thickeners, dispersants, and fillers.

The ink composition may be prepared by uniformly mixing or kneading the vehicle for the ink, colorant, and additives by an ordinary method such as roll mill method, the ball mill method, the attritor method or the sand mill method.

Fountain inks may contain not only water, but also water modified by such substances as desensitization accelerators, buffers, preservatives, and wetting agents. Examples of such substances are gum arabic, carboxymethylcellulose, sodium alginate, polyvinyl pyrrolidine, polyvinyl imidazole, polyvinyl methyl ether-maleic anhydride copolymers, carboxymethyl starch, ammonium alginate, methyl cellulose sulfates (e.g. sodium sulfate and ammonium sulfate), phosphoric acid, nitric acid, nitrous acid, tannic acid and salts thereof, polyol compounds having two or more hydroxyl groups (polyethylene glycols, ethylene glycol, propylene glycol, glycerol, diethylene glycol, hexylene glycol), organic weak acids (citric acid, succinic acid, tartaric acid, adipic acid, ascorbic acid, propionic acid), polyacrylic acid, ammonium bichromate, alginic ester of propylene glycol, aminopolycarboxylate (e.g. ethylenediaminetetraacetic acid sodium salt), inorganic colloids (e.g. colloidal silica), and surface active agents. These compounds are used each alone or in mixtures. In addition to the above compounds there can be used water-miscible organic solvents such as methanol, dimethylformamide, and dioxane, a small amount of colorants such as phthalocyanine dyes, malachite green, and ultramarines.

Krishnan et al., U.S. Pat. Nos. 5,725,646 and 5,778,789 disclose water-based lithographic printing inks. The main reason for using this type of system is to reduce the volatile organic compounds (VOCs) found in conventional lithographic ink. A water-based lithographic printing ink requires a printing plate with hydrophilic image area and hydrophobic non-image area. If a volatile hydrocarbon fountain solution is required, there will not be a significant reduction of VOCs in the process.

The invention of waterless lithographic printing plates eliminates the use of fountain solutions. The non-image area is coated with a polymer, such as silicon, which is ink repellant. Lint and debris tend to damage the surface of such a plate which limits the life of the plate. The difference in surface energy between the image and non-image areas of conventional offset lithographic printing plates is typically 40 dynes/cm, while that for waterless printing plates is around 20 dynes/cm. This narrower surface energy difference increases scumming, where the non-image area accepts and transfers ink to the blanket and subsequently to the print.

There are many advantages of transfer printing versus direct printing. In transfer printing, the final image may appear on substrates other than those which are easily processed by a printer. Printed images may be transferred onto textiles, such as clothing, whereas direct printing onto the clothing may be problematic. The image may be printed onto a substrate, which acts as an intermediate medium, and stored until use at a later time. The storage time may be indefinite prior to transfer to the final substrate. This is especially advantageous in the garment industry, where fashions change rapidly. Through the use of transfers, printed fabrics are not wasted when styles change. Another advantage of transfer printing is that the printed image may be transferred onto any suitable substrate regardless of shape, size, or composition.

Transfer processes using sublimation, or disperse, dyes are known in the art. See, Hale, U.S. Pat. No. 5,246,518, for example. Sublimation dye solids change to a gas at about 400° F, and have a high affinity for polyester at the activation temperature. While sublimation dyes yield excellent results when a polyester substrate is used, these dyes have a limited affinity for other materials, such as natural fabrics like cotton and wool.

Accordingly, images produced by heat activated inks comprising sublimation dyes which are transferred onto textile materials having a high percentage of natural fabric as a component, such as cotton, wool or silk, do not yield the high quality image experienced when images formed by such inks are printed onto a polyester substrate. Image transfer, using sublimation dyes and applied heat and pressure, onto substrates of natural fabric, such as cotton, or cotton and polyester blends, yields poor results.

Plate printing processes, and particlularly offset lithography, are the most widely used forms of printing. A need exists for image transfer processes where the image is printed by a plate printing process, and is subsequently permanently transferred to substrates which do not have a polymer or polyester component, such as natural textile fabrics. A long shelf life of the ink prior to final transfer of the image is also a requirement.

SUMMARY OF THE INVENTION

This invention is a transfer process, wherein an image is printed onto a first substrate using lithography, intaglio, gravure, relief printing or other printing process which uses plates, and the image is transferred from the first substrate to a final substrate. The ink formulation which is printed and transferred comprises colorants, such as dyes or pigments, including sublimation dyes, polymeric dyes or other dyes, any of which may be referred to herein as colorants. The term "plate printing process" is adopted, defined and used herein to mean printing processes in which plates are used as printing surfaces, whether such plates are flat, or curved, such as cylinders, or whether such plates are aluminum, rubber, synthetics, or other commonly used materials, and includes relief printing, such as letter press and flexography; planography, such as lithography and intaglio, such as gravure or rotogravure, but does not include screen printing, for example, since no printing plate is used to form the image. More specifically, this invention is a plate printing process in which an image is first printed onto a substrate which acts as an intermediate medium, which may be paper. The printed image may then be heat transferred to a final substrate, including textiles of natural fabric, such as cotton.

Bonding and/or crosslinking of the color images of the present invention are provided by the reaction between compounds selected from each of two chemical groups. The first group comprises compounds with functional groups capable of reacting with active hydrogen, such as isocyanate or epoxy groups. The second group comprises compounds with functional groups containing active hydrogen, such as hydroxyl, amino, thiol, or carboxylic acid groups, or compounds with functional groups containing active hydrogen after a conversion process, such as anhydride groups.

To prevent premature or undesired reaction, the functional groups of one or both reactive chemical groups are protected either by chemical blocking with blocking agents or by physical barrier such as encapsulating agents. The protecting agents are removed by the application of heat in a specific temperature range.

The inks contain compounds from one or both reactive chemical groups. The inks are preferably hydrophobic and soluble in organic solvents. The image may be printed by the printer onto substrate or intermediate medium, which may be paper, may have a receiving layer that contains compounds from one or both reactive chemical groups. To enhance the permanent bonding of the image on the final substrate, a layer of binding material, which may contain a polymeric binder, may be printed with the color inks.

DESCRIPTION OF THE PREFERRED EMBODIMENTS

This invention relates to printing methods generally, such as lithographic, intaglio, etc., and is more specifically directed to a method of transfer printing of ink onto an intermediate medium, and subsequently heat activating the ink to permanently fix the printed image onto a final substrate. In a preferred embodiment of the present invention, a lithographic printing press prints an image with colored inks onto an intermediate medium, such as paper. The image is transferred to a final substrate with which the colorant(s) bond permanently by means of reaction among components in the image material and the final substrate.

Bonding and/or crosslinking of the color images of the present invention are provided by the reaction between compounds selected from each of two chemical groups. The first group comprises compounds with functional groups capable of reacting with active hydrogen, such as isocyanate or epoxy groups. A preferred set of compounds comprising isocyanate groups is referred to as polyisocyanates. The second group comprises compounds with functional groups containing active hydrogen, such as hydroxyl, amino, thiol, carboxylic acid groups, or compounds with functional groups containing active hydrogen after a conversion process, such as anhydride groups. A preferred set of compounds comprises hydroxyl groups and is referred to herein as polyols.

Isocyanate functional groups are very reactive and atmospheric moisture will initiate curing at room temperature. Epoxy functional groups require the presence of catalysts and/or elevated temperature for full curing, however, some reaction will occur over time. To prevent premature or undesired reaction, these functional groups are protected either by chemical blocking with blocking agents or by physical barrier such as encapsulating agents. The protecting agents are preferably removed by the application of heat, allowing reaction between the compounds selected from each of the two chemical groups. Other processes may include, but are not limited to radiation, chemical, pressure, and/or the combinations thereof.

Ink used in the printing process may comprise compounds from one or both reactive chemical groups. In a preferred embodiment, the ink contains polyol and polyisocyanate compounds. The use of polyols in the present invention meets two primary goals of the invention. Many polyols are wax-like materials which act as lubricants and release agents during the transfer of the printed ink image from the intermediate medium to the final substrate. The polyols also supply functional groups having active hydrogens capable of crosslinking with active isocyanate and permanently bonding to the final substrate. Furthermore, wax-like polyol may partially or completely replace waxes in the printing ink formulation and hence improve image quality.

Another embodiment of the present invention requires the polyol and blocked or hindered polyisocyanate to be present in separate ink formulations, for example, in separate colors. Preferably, the ink containing the polyol will be offset onto the intermediate medium first, followed by ink containing the blocked polyisocyanate. The advantage of this method of printing is that the polyol containing ink layer will be in closest contact with the intermediate medium, such as paper, and therefore, provide improved release from the intermediate medium during heat transfer to the final substrate.

In another embodiment of the present invention, the intermediate medium may have a receiving layer that contains compounds from one or both reactive chemical groups. In one embodiment, the receiving layer contains polyisocyanate compounds. The receiving layer may include a plasticizer, such as phthalates or adipates, to impart increased flexibility to the substrate. The receiving layer may also include polymeric binder material. A release layer, which may be polymeric, may be present between the intermediate medium and the receiving layer. In a preferred embodiment, the receiving layer contains the polyol component, which acts as a release layer and a crosslinking component with the polyisocyanate in the printed ink.

In the printing process an ink image is first printed onto an intermediate medium, which may be paper. Printing of the ink image onto the intermediate medium takes place at a temperature sufficient to print the ink without removing the blocking groups and subsequently activating bonding and/or cross-linking of the ink, either within the ink itself, or between the ink and the intermediate medium or optional receiving layer. A higher temperature is applied, preferably with pressure from a heat press, to transfer the image from the intermediate medium to the final substrate. The heat simultaneously activates and permanently fixes the ink onto the final substrate. In this manner, the image becomes permanently embedded in the substrate and excellent durability can be achieved for the final designed image. Appropriate pressure is applied during the transfer process to ensure the proper surface contact of the medium and the final substrate.

Polyols suitable for use in the present invention may have an average functionality between two and four hydroxyl groups per molecule. In general, polyols or mixtures thereof may have an average molecular weight from 500 to 50,000 and preferably, an average molecular weight in the range of 1,000 to 3,000. The average molecular weight of the whole of all polyol compounds is defined as the sum of the product of the molecular weight and the mole fraction of each polyol compound in the mixture. A preferred embodiment of an ink comprises a mixture of high molecular weight polyol compounds having molecular weights of 3000 to 10,000, and low molecular weight polyol compounds having molecular weights of not greater than 600.

It will be appreciated by one skilled in the art that other hydroxyl-containing materials may be used without departing from the spirit of the present invention. Other suitable active hydrogen-containing functional groups include amino, thiol, carboxylic acid, and anhydride groups.

Polyisocyanates suitable for the present invention are aliphatic and/or cycloaliphatic and/or aromatic polyisocyanates. Particularly preferred are polyisocyanates in which all the isocyanate groups are attached to aliphatic carbon atoms. Aliphatic polyisocyanates suitable for the present invention include those having the structure:

$$OCN—(CH2)n—NCO$$

where n is an integer from 2 to 16, and preferably 4 or 6, i.e., tetramethylene diisocyanate and hexamethylene diisocyanate (HDI). Other suitable aliphatic and cycloaliphatic isocyanates are: 1-isocyanato-3-isocyanatomethyl-3,5,5-trimethyl-cyclohexane (known commercially as isophorone diisocyanate (IPDI)), trimethylhexamethylene diisocyanate, the isomeric bis(isocyanatomethyl)benzenes and toluenes, 1,4-bis(isocyanatomethyl)-cyclohexane, 4,4'-methylene bis (cyclohexylisocyanate), cyclohexane-1,4-diisocyanate, and the like. Such aliphatic polyisocyanates may be used either alone, or in a mixture with one or more of the other aliphatic polyisocyanates listed above.

Examples of aromatic isocyanates suitable for the present invention are 2,4-toluene diisocyanate, 2,6-toluene diisocyanate, commercial mixtures of 2,4- and 2,6-toluene diisocyanate, 4,4'-diphenylmethane diisocyanate, dianisidiene diisocyanate, the isomeric benzene, xylene and naphthalene diisocyanates. Such aromatic polyisocyanates may be used alone or in a mixture with other aromatic polyisocyanates, such as those listed above, or with the aliphatic polyisocyanates listed above.

In place of polyisocyanates, polyisothiocyanates, or compounds containing both isocyanate and isothiocyanate groups may be used, for example, hexamethylene diisothiocyanate, tetramethylene diisothiocyanate, 2,4- and 2,6-toluene diisothiocyanate.

To prevent premature reaction of the isocyanates or polyisocyanates, blocked or hindered isocyanates or polyisocyanates are used. A blocked isocyanate, as used herein, is derived from the reaction of a blocking agent and an isocyanate. Such blocked isocyanates reform the original isocyanate upon removal of the blocking agents such as by heating, or by heating with nucleophilic reagents, and may produce the same products as the reaction of the same nucleophilic reagents with the parent isocyanates. Blocking and isocyanate groups are specifically chosen so that the temperature for unblocking is in the range of 60–220° C. Unblocking temperatures lower than 60° C. do not provide suitable storage stability either for the ink or for the printed intermediate medium. In addition, the temperature required to remove the protecting agents from these chemical groups must be greater than the temperature at which printing onto the intermediate medium occurs. Typical heat transfer temperatures are in the range of 175–220° C., and therefore the unblocking temperature must be at or below this temperature. In addition, unblocking temperatures higher than 220° C. are undesirable since temperatures higher than this may damage the final substrate during heat transfer. Preferably, the unblocking reaction occurs upon the application of heat between 120° C. and 200° C.

Common examples of blocking agents include phenols and substituted phenols, alcohols and substituted alcohols, thiols, lactams such as alphapyrrolidone, epsilon-caprolactam, mercaptams, primary and secondary acid amides, imides, aromatic and aliphatic amines, active methylene compounds, oximes of aldehydes and ketones and salts of sulfurous acid. The polyisocyanate and the polyol compounds are preferred to have an average functionality between two and four. The ratio of the equivalents of isocyanate groups to the equivalents of hydroxyl groups may range from 1/2 to 10/1, preferably 1/1 to 2/1.

Catalysts may be included to catalyze the cross-linking reaction. Examples of catalysts for the isocyanate/polyol reaction include tertiary amines, such as triethylamine, triethylenediamine, hexahydro-N,N'-dimethyl aniline, tribenzylamine, N-methyl-piperidine, N,N'-dimethylpiperazine; alkali or alkaline earth metal hydroxides; heavy metal ions, such as iron(III), manganese(III), vanadium(V) or metal salts such as lead oleate, lead-2-ethylhexanoate, zinc(II)octanoate, lead and cobalt napththenate, zinc(II)-ethylhexanoate, dibutyltin dilaurate, dibutyltin diacetate, and also bismuth, antimony and arsenic compounds, for example tributyl arsenic, triethylstilbene oxide or phenyldichlorostilbene. Particularly preferred are dibutyl tin catalysts.

Polymeric binder materials may be incorporated into the ink, receiving layer, or release layer formulations. These materials may include resins and mixtures thereof. Resins which may be used include rosin and modified rosins, such as calcium, magnesium, and zinc metallic resinates, ester gum of rosin, maleic resins and esters, dimerized and polymerized rosins and rosin modified fumaric resins; shellac, asphalts, phenolic resins and rosin-modified phenolic resins; alkyd resins; polystyrene resins and copolymers thereof; terpene resins; alkylated urea formaldehyde resins; alkylated melamine formaldehyde resins; polyamide resins; vinyl resins and copolymers thereof, such as polyvinyl acetate, polyvinyl alcohol, ethylene-vinyl acetate, and polyvinyl butyral; ketone resins; acrylic resins, such as polyacrylic acid and polymethacrylic acid; epoxide resins; polyurethane resins; polyester resins; cellulosic resins, such as nitro cellulose, ethyl cellulose, cellulose acetate butyrate and carboxymethyl cellulose.

The colorants used in the ink may be dyes or pigments. Suitable dyestuffs include, but are not limited to pigments, Acid Dyes, Direct Dyes, Basic Dyes, Solvent Dyes, Disperse Dyes, Sulphur Dyes or Vat Dyes. Preferred are colorants which contain a hydroxy, amine, or other active hydrogen containing functional group that is capable of reacting with an isocyanate. More preferred are those which contain at least one hydroxyl group.

The printing ink for the present invention may be in a system with solvent as carrier material. Suitable solvents include ketones, esters, alcohols, glycol ethers, glycol ether esters, and aromatic hydrocarbons. Examples include methyl ethyl ketone, methyl amyl ketone, methyl isobutyl ketone, methanol, ethanol, isopropanol, toluene, xylene, propylene glycol monomethyl ether, propylene glycol monomethyl ether acetate, butyl acetate, and N-methyl pyrrolidinone.

Other ingredients in the ink formulations may include waxes, greases, plasticizers, stabilizers, drying agents, thickeners, dispersants, and fillers.

The final transfer substrate may include plastics, metals, wood, glass, ceramics, paper, or textile materials. The substrates must be able to withstand the heat transfer temperature without deforming, melting or degrading. The substrate should either contain compounds that have groups containing active hydrogen or have a surface so that permanent bonding with the image can be achieved.

The preferred final transfer substrates are textile substrate materials containing hydroxyl groups and/or primary or secondary amino groups that react with the free isocyanate. Chemical grafting is achieved through copolymerization between the ink layer components and final substrate material, resulting in superior stability and durability. Such materials include cotton, secondary cellulose acetate, rayon, wool, silk, and polyamides such as nylon 6, nylon 6.6 and nylon 12.

Thermally expandable ink may be produced which comprises an expanding agent. Simultaneous expanding and cross-linking gives a three-dimensional image which is permanently bound to the substrate. The height of the image is dependent on the concentration of expanding agent, the temperature and the pressure applied during heat transfer printing. Preferable expanding agents include those which decompose upon heating to release gaseous products which cause the ink to expand. Such expanding agents, known as chemical blowing agents include organic expanding agents such as azo compounds, including azobisisobutyronitrile, azodicarbonamide, and diazoaminobenzene, nitroso compounds such as N,N'-dinitrosopentamethylenetetramine, N,N'-dinitroso-N,N'-dimethylterephthalamide, sulfonyl hydrazides such as benzenesulfonyl hydrazide, p-toluenesulfonyl hydrazide, p-toluenesulfonyl azide, hydrazolcarbonamide, acetone-p-sulfonyl hydrazone; and inorganic expanding agents, such as sodium bicarbonate, ammonium carbonate and ammonium bicarbonate.

A thermally expandable ink may be produced which comprises volatile hydrocarbons encapsulated in a microsphere which bursts upon the application of heat. The gaseous products produced upon bursting expand the ink. Thermally expandable microcapsules are composed of a hydrocarbon, which is volatile at low temperatures, positioned within a wall of thermoplastic resin. Examples of hydrocarbons suitable for practicing the present invention are methyl chloride, methyl bromide, trichloroethane, dichioroethane, n-butane, n-heptane, n-propane, n-hexane, n-pentane, isobutane, isophetane, neopentane, petroleum ether, and aliphatic hydrocarbon containing fluorine such as Freon, or a mixture thereof.

Examples of the materials which are suitable for forming the wall of the thermally expandable microcapsule include polymers of vinylidene chloride, acrylonitrile, styrene, polycarbonate, methyl methacrylate, ethyl acrylate and vinyl acetate, copolymers of these monomers, and mixtures of the polymers of the copolymers. A crosslinking agent may be used as appropriate. The diameter of the thermally expanded microcapsule is in the range of 0.1–300 microns, and preferably within a range of 0.3–50 microns, with a greater preference of a range of 0.5–20 microns.

The process of the present invention is a transfer processes where the image is printed by a plate printing process onto a first substrate, which may be paper, and the image is subsequently permanently transferred to a substrate which does not have a polymer or polyester component, such as natural textile fabrics. A long shelf life of the ink prior to final transfer of the image is achieved by storage of the image on the intermediate medium or transfer sheet.

What is claimed is:

1. A plate printing process using reactive ink, comprising the steps of:

a. preparing an ink comprising a colorant, at least one compound having at least one functional group which reacts with active hydrogen, and at least one compound having at least one functional group containing active hydrogen;

b. supplying an offset printing device with said ink;

c. printing said ink by means of said offset printing device on a first substrate to form an image on said first substrate; and d. subsequently transferring said image from said first substrate to a final substrate by applying heat to said first substrate and reacting said at least one compound having at least one functional group which reacts with active hydrogen with said at least one compound having at least one functional group containing active hydrogen to bond said image to said final substrate.

2. A plate printing process using reactive ink as described in claim 1, wherein said ink further comprises a blocking agent which, during printing of said ink, prevents a reaction between said at least one compound having at least one functional group which reacts with active hydrogen, and said at least one compound having at least one functional group containing active hydrogen, and thereafter, upon the application of heat to said first substrate, said blocking agent is removed.

3. A plate printing process using reactive ink as described in claim 1, wherein said at least one compound having at least one functional group which reacts with active hydrogen is an isocyanate.

4. A plate printing process using reactive ink as described in claim 1, wherein said at least one compound having at least one functional group containing active hydrogen is a polyol.

5. A plate printing process using reactive ink as described in claim 2, wherein said at least one compound having at least one functional group which reacts with active hydrogen is an isocyanate.

6. A plate printing process using reactive ink as described in claim 2, wherein said at least one compound having at least one functional group containing active hydrogen is a polyol.

7. A plate printing process using reactive ink as described in claim 3, wherein said at least one compound having at least one functional group containing active hydrogen is a polyol.

8. A plate printing process using reactive ink as described in claim 1, wherein said ink is non aqueous.

9. A plate printing process using reactive ink as described in claim 1, wherein said ink is non ionic.

* * * * *

UNITED STATES PATENT AND TRADEMARK OFFICE

CERTIFICATE OF CORRECTION

PATENT NO : 6,105,502

DATED : August 22, 2000

INVENTOR(S) : Wagner, et al.

It is certified that error appears in the above-identified patent and that said Letters Patent are hereby corrected as shown below:

Inventors should be corrected to read as follows: Kimberlee Thompson; Barbara Wagner; Ming Xu, all of Mt. Pleasant, S.C.

Signed and Sealed this

Eighth Day of May, 2001

*Attest:*

Nicholas P. Godici

NICHOLAS P. GODICI

*Attesting Officer*

*Acting Director of the United States Patent and Trademark Office*